United States Patent [19]

Morey et al.

[11] Patent Number: 4,974,576

[45] Date of Patent: Dec. 4, 1990

[54] ARCHERY BOW ALIGNMENT DEVICE AND METHOD

[75] Inventors: Harry D. Morey, P.O. Box 11285, S. Winn Rd., Shepherd, Mich. 48885; Thomas E. Giesken, Riverdale, Mich.

[73] Assignee: Harry D. Morey, Shepherd, Mich. ; a part interest

[21] Appl. No.: 243,258

[22] Filed: Sep. 12, 1988

[51] Int. Cl.[5] ..... F41B 5/00

[52] U.S. Cl. ..... 124/91; 124/87; 124/1; 124/88; 33/265; 248/278; 248/688; 269/51; 269/60

[58] Field of Search ..... 124/86, 87, 88, 89, 124/90, 91, 1, DIG. 1; 33/265; 248/278, 688; 269/60, 71, 50, 51, 52

[56] References Cited

U.S. PATENT DOCUMENTS

| | | | |
|---|---|---|---|
| 3,038,262 | 6/1962 | Fuhrer et al. | 33/180 R |
| 3,088,212 | 5/1963 | Smith | 33/180 R |
| 3,111,772 | 11/1963 | Hartog | 33/180 R |
| 3,281,928 | 11/1966 | Dolch | 124/86 X |
| 3,286,961 | 11/1966 | Mandolare | 248/44 |
| 3,584,820 | 6/1971 | Butcher, Sr. | 248/122 |
| 3,600,814 | 8/1971 | Smith | 33/180 R |
| 3,623,468 | 11/1971 | Crest | 124/24 |
| 3,651,578 | 3/1972 | Saunders et al. | 33/180 R |
| 3,969,825 | 7/1976 | Mathes | 124/24 R X |
| 4,048,726 | 9/1977 | LeFebvre | 33/265 X |
| 4,175,343 | 11/1979 | Mathews | 269/51 X |
| 4,382,339 | 5/1983 | Saunders | 33/265 |
| 4,398,354 | 8/1983 | Finlay | 33/180 R |
| 4,567,668 | 2/1986 | King et al. | 33/265 X |
| 4,594,786 | 6/1986 | Rezmer | 33/265 X |
| 4,596,229 | 6/1986 | Bell | 124/24 R |
| 4,660,814 | 4/1987 | Shader | 269/71 X |
| 4,703,922 | 11/1987 | Schell | 269/71 X |
| 4,817,579 | 4/1989 | Mathias | 124/86 X |
| 4,846,140 | 7/1989 | DiMartino | 124/86 X |

*Primary Examiner*—Randolph A. Reese
*Assistant Examiner*—Carol I. Bordas
*Attorney, Agent, or Firm*—Price, Heneveld, Cooper, DeWitt & Litton

[57] ABSTRACT

A method and apparatus for precisely positioning various components of a compound bow is accomplished through the use of a device which adjustably, but securely, holds a compound bow in either a vertical orientation for the positioning of the nock or a horizontal orientation for the positioning of the arrow shelf, sights and pulleys. The method and apparatus of the present invention effectively alleviates the built-in inaccuracies in shooting an arrow. More specifically, the user can accurately position the nock on the main bow string, precisely align the arrow shelf with the main bow string, accurately align the sight bar on the bow with the peep sight on the main bow string, and check the accuracy of the alignment of the pulleys.

7 Claims, 3 Drawing Sheets

ARCHERY BOW ALIGNMENT DEVICE AND METHOD

BACKGROUND OF THE INVENTION

The present invention pertains to archery bow alignment devices, and in particular to a device specially suited to properly position various elements on a compound bow.

Accurate shooting is a fundamental skill in the sport of archery, regardless of whether one is engaged in hunting or tournaments. However, irrespective of one's expertise, accuracy in shooting can only be achieved with proper positioning and alignment of a number of elements on the bow. For instance, reliable and consistent shooting of a compound archery bow depends greatly on the proper positioning of the nocking point, the sights, the arrow shelf and the pulleys. Imprecise or misaligned positioning of any or all of these elements will invariably negatively affect the accuracy of the arrow's flight.

In the past, it has been discovered that even premium quality bows are not consistently constructed with perfectly aligned pulleys, nocking point and shelf arrangements or sights. Moreover, arrow shelves and sights are typically sold separately from the bows and subsequently installed by the user. Hence, even in the precise manufacture of bows, the subsequent installation of these parts often results in the establishing of built-in inaccuracies in shooting.

In an effort to alleviate these difficulties, many bow squares have been developed primarily for setting the position of the nocking point. Some also additionally may be used for checking the location of the sight. Examples of such devices are disclosed in U.S. Pat. No. 4,594,786 issued June 17, 1986, to Rezmer, and entitled BOW SQUARE, and U.S. Pat. No. 3,651,578 issued Mar. 28, 1972, to Saunders et al., and entitled BOW CHECKING AND CALIBRATING DEVICE. However, these implements are only concerned with some of the elements and are therefore capable of only remedying a portion of the problems associated with accurate archery shooting.

SUMMARY OF THE INVENTION

The aforementioned problems and deficiencies are overcome in the present invention, wherein the salient features on a compound bow can be accurately positioned in an easy and efficient manner. Essentially, the positioning is accomplished through the use of a device which adjustably, but securely, holds a compound bow in either a vertical orientation for the positioning of the nocking point or a horizontal orientation for the positioning of the arrow shelf, sights and pulleys. These checks and placements are easily performed by the user through the use of levels, plumb bobs and the like in conjunction with the holding device.

By utilizing the method and apparatus of the present invention, the user may effectively alleviate the built-in inaccuracies in shooting an arrow. More specifically, the user can accurately position the nocking point on the main bow string, precisely align the arrow shelf with the main bow string, accurately align the sight bar on the bow with a peep sight on the main bow string, and check the accuracy of the alignment of the pulleys. Further, these advantageous operations can be performed by all archers quickly and easily, and without specialized skill or training.

These and other objects, advantages and features of the present invention will be more fully understood and appreciated by reference to the written specification and appended drawings.

DETAILED DESCRIPTION OF THE PREFERRED EMBODIMENTS

Figure 1:
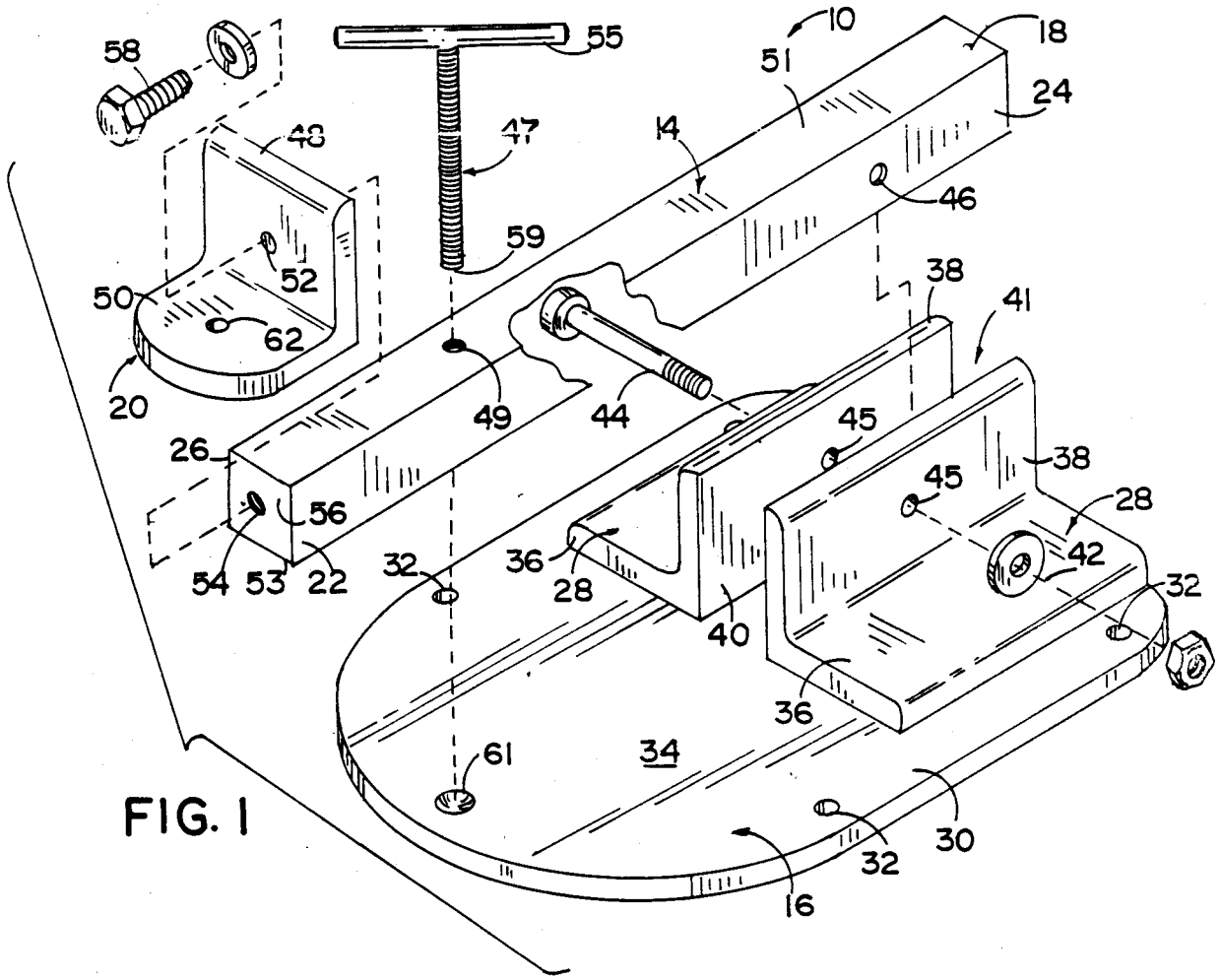
FIG. 1 is an exploded perspective view of the aligning device of the present invention.

In the preferred embodiment, a bow alignment device 10 (FIGS. 1–4) is utilized to perform the unique method of precisely positioning various components on a compound bow 12 (FIG. 5) which are critical to accurate shooting. Alignment device 10 includes an arm 14 pivotally secured to a base 16 on one end 18 and pivotally mounts a mounting bracket 20 on the other end 22 thereof. These cooperating connections and elements function to permit bow 12 to be positioned in the desired orientation for locating a particular component.

Arm 14 (FIGS. 1, 2 and 4) is an elongated member which functions to support and adjust bow 12 for the various alignment procedures to be discussed below. Preferably, arm 14 is composed of aluminum or other material having the requisite strength and rigidity characteristics. Arm 14 is preferably of square cross section with opposite sidewalls 24, 26, which fit between flanges 38 of braces 28 of base 16. Other shapes could be used if flats or the like are provided along end 18 to facilitate the interface with braces 28.

More specifically, base 16 (FIGS. 1, 2 and 4) includes a flat mounting plate 30 which generally rests upon a stable support. Preferably, base 16 is composed of a rigid metallic material, but could be composed of other materials having the requisite characteristics. Mounting holes 32 are provided in each corner of plate 30 to facilitate its bolting in a generally horizontal position to a workbench or the like. Of course, other mounting arrangements, such as securing the base with a C-clamp, could be used so long as base 16 is securely held against movement.

Figure 4:
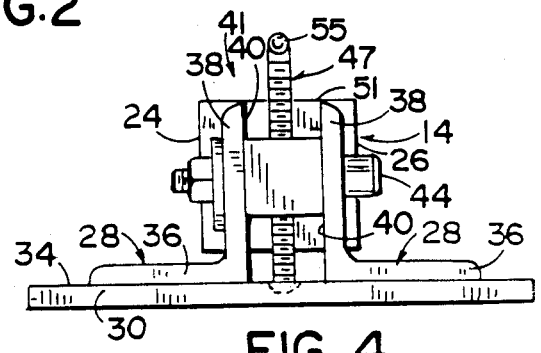
FIG. 4 is a rear end elevational view thereof.

Along an upper surface 34 of mounting plate 30 are fixedly secured a pair of substantially L-shaped braces 28 (FIGS. 1 and 4). Each brace 28 preferably includes a securing flange 36 which lies contiguously along upper surface 34 and is welded or otherwise secured thereto, and an upstanding flange 38 which extends upwardly at right angles thereto. Upstanding flanges 38 include inwardly directed opposed faces 40 which are precisely machined. Faces 40 are spaced apart to define a gap 41 having a width equal to the width of arm 14 to effect mating receipt thereof. More particularly, each face 40 engages a corresponding sidewall 24, 26 and thereby prevents the arm from experiencing any lateral motion.

The movement of arm 14 is controlled not only by faces 40, but also by a pivot pin 44 which allows arm 14 to pivotally move about axis 42 (FIG. 2) in a vertical plane defined between faces 40 (as shown by arrows 43). In use, arm 14 will typically only be pivoted a few degrees to either side of a horizontal orientation. More specifically, upstanding flanges 38 and arm 14 are each provided with aligned apertures 45,46 which receive therethrough pivot pin 44. Pivot pin 44 may be bolted or otherwise secured in place so as to avoid inadvertent dislodgement thereof.

To effect the vertical pivoting of arm 14 in a controlled manner, a control screw 47 is received through a threaded opening 49 near the opposite end 22 of arm 14 (FIGS. 1–4). Control screw 47 passes through upper and lower surfaces 51, 53 of arm 14 and therefore lies within the vertical plane within which arm 14 moves. More specifically, control screw 47 is provided with a handle portion 55 and an abutment end 59 which is adapted to engage a concave dimple 61 formed in the upper surface 34 of base 16. Hence, arm 14 is pivotally moved upwardly and downwardly by threading control screw 47 through opening 49.

Figure 5:
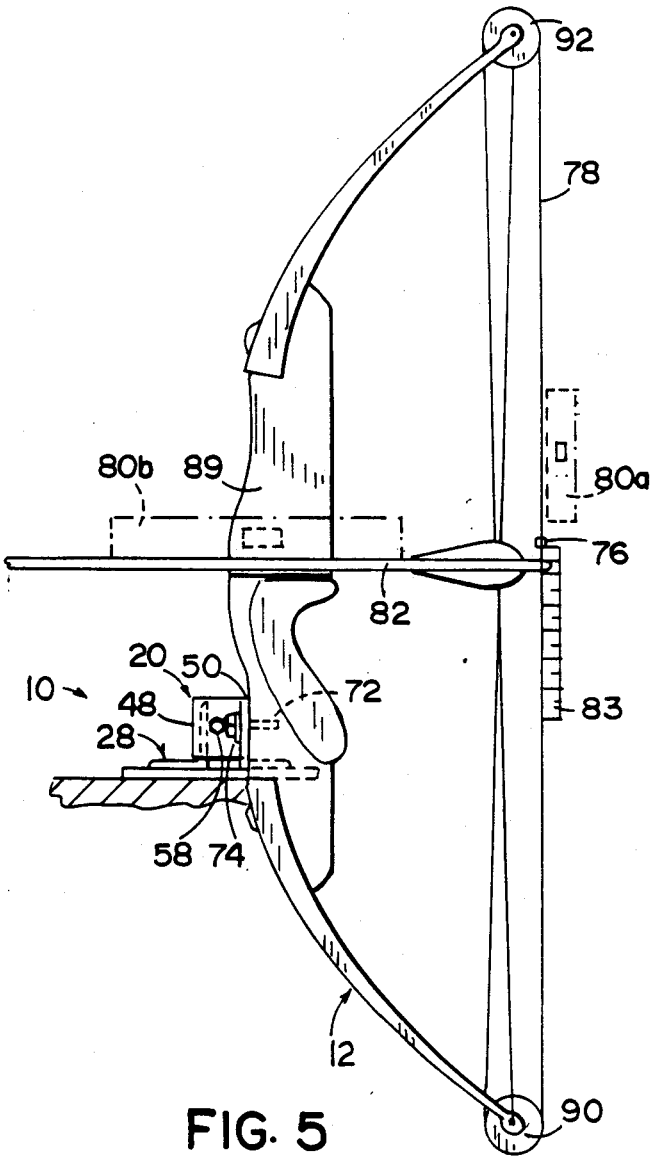
FIG. 5 is an elevational view of a bow and the device of the present invention in use for setting the nock.
Figure 6:
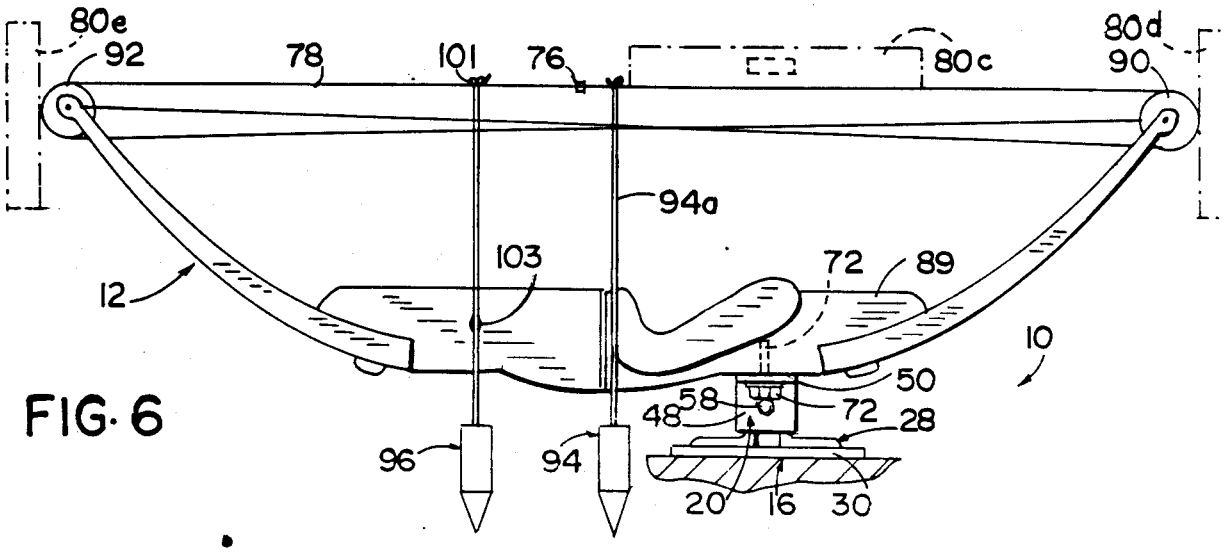
FIG. 6 is an elevational view of a bow and the device of the present invention in use for checking and setting the alignment of the pulleys, the positioning of the arrow shelf, and the positioning of the sight bar.

A substantially L-shaped (preferably metallic) mounting bracket 20 (FIGS. 1–3) is rotationally secured to the distal end 22 of arm 14. Mounting bracket 20 includes a base leg 48 which attaches to arm 14 and an orthogonal projecting leg 50 which facilitates attachment of a compound bow 12 to device 10. Base leg 48 is positioned flush against arm end face 56 and is provided with a hole 52 which is aligned with a tapped bore 54 in end face 56. A screw 58 or the like is received through hole 52 and into tapped bore 54 for attaching mounting bracket 20 to the end of arm 14. In this arrangement, screw 58 may be loosened to permit rotative movement (as shown by arrows 57) of mounting bracket 20 about an axis 60 (FIG. 3) orthogonal to axis 42 until bow 12, attached to bracket 20 as seen in FIGS. 5 and 6, is positioned in the desired orientation. Once this has been accomplished, screw 58 is tightened into tapped bore 54 so that mounting bracket 20 is rigidly secured against further movement.

Figure 2:
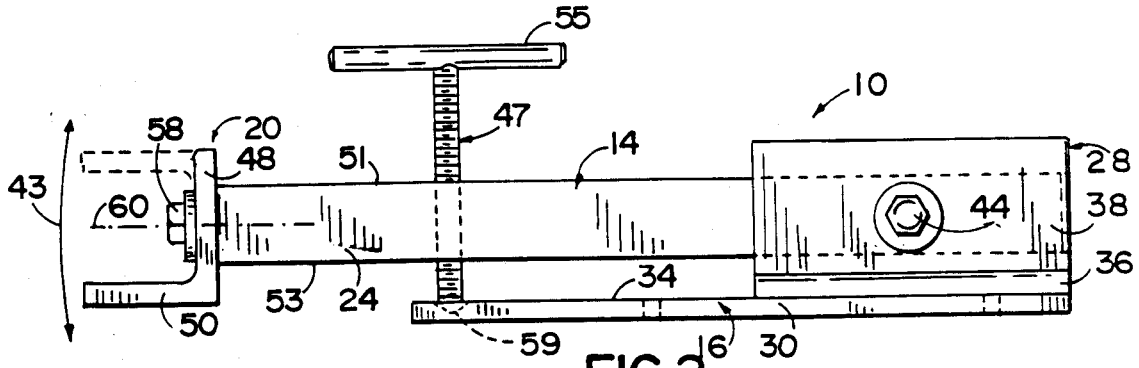
FIG. 2 is a left side elevational view thereof.
Figure 3:
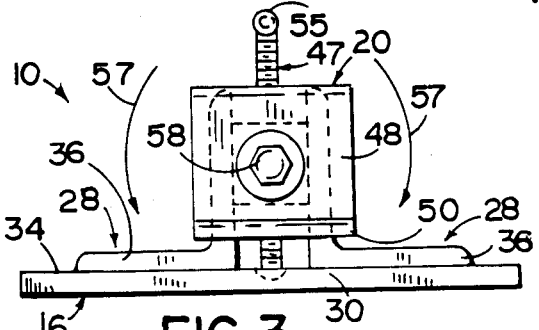
FIG. 3 is a front end elevational view thereof.

Projecting leg 50 extends outwardly from base leg 48 at substantially a right angle thereto (FIGS. 1 and 2). Similar to base leg 48, projecting leg 50 is provided with a hole 62 which is aligned with a threaded bore 72 provided in bow 12 for the insertion of a stabilizer bar. Bow 12 is then attached to mounting bracket 20 by inserting a screw 74 or the like through hole 62 and into threaded bore 72 so that bow 12 is fixedly secured against movement relative to mounting bracket 20.

In operation, bow 12 is first mounted onto projecting leg 50 of mounting bracket 20 by screw 74 as discussed above. To precisely position the nocking point 76 onto the main bow string 78, screw 58 is loosened and mounting bracket 20 is oriented such that projecting leg 50 lies approximately in a vertical plane (FIG. 5). Screw 58 is then partially tightened so that mounting bracket 20 and bow 12 are held in a stationary manner, but are still movable upon the application of manual force thereto. With bracket 20 in this position, main bow string 78 is positioned in an approximate vertical orientation.

In the placing of the nocking point, it is essential that main bow string 78 be placed in a substantially true vertical position. To ensure that this is achieved, a level **80*a* is placed on main bow string 78, as shown in FIG. 5. Bow 12 is then rotated about axis 60 until a level 80*a* indicates that main bow string 78** is vertically oriented.

Once the orientation of main bow string 78 is achieved and screw 58 is firmly tightened, an arrow 82 is placed onto the arrow shelf 84 with its notched end fitted onto main bow string 78. Level **80*b* is then placed on arrow 82 to facilitate the positioning of the arrow into a substantially true horizontal position. Once this is achieved, and arrow 82 and main bow string 78 are at right angles to one another, the nocking point 76 is positioned above arrow 82 a predetermined distance along bow string 78 through the use of a conventional scale 83**. The particular distance varies from bow to bow and is dependent on the length of the pull and the distance between the pulleys. Typically, the distance is on the order of one quarter inch to one half inch.

Figure 9:
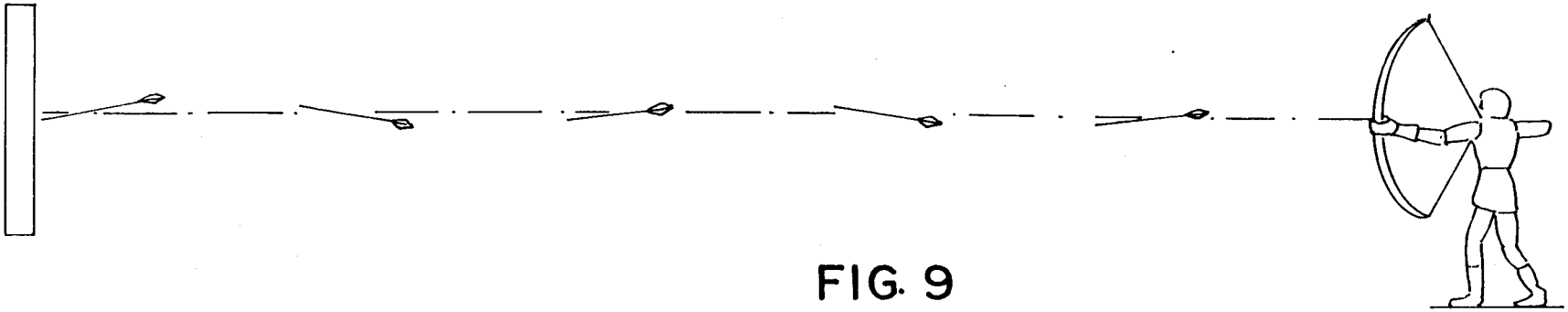
FIG. 9 is an illustration of the shooting problems associated with a mispositioned nock.

If the nocking point 76 is not accurately positioned, arrow 82 will be tipped upon its release, such that a wobbling flight path ensues. As illustrated in FIG. 9, this type of wobbling will invariably negatively affect the accuracy of the shot.

For the other adjustments, the bow 12 is rotated about axis 60 so that main bow string 78 is moved into a generally horizontal position with the bow body 89 positioned therebeneath (FIG. 6). More particularly, screw 58 is loosened to permit rotation of mounting bracket 20 until the projecting leg 50 is above base leg 40 and oriented into an approximate horizontal plane. Once this position is reached, screw 58 is partially tightened until mounting bracket 20 is held steady, but is still subject to adjustment upon the application of manual force thereto. In a manner similar to the previously discussed operation, a level **80*c* is placed upon main bow string 78 and is utilized to precisely position main bow string 78 in a substantially true horizontal orientation. Once this position has been achieved, screw 58 is tightened so that mounting bracket 20** is fixedly held against movement.

To enable accurate shooting with a compound bow, it is critical that the pulleys 90, 92 are aligned with one another. As can be readily appreciated, if pulleys 90, 92 are not aligned with one another, they will tend to wobble relative to one another as they are rotated in drawing and releasing the bow string 78. The corresponding wobble then imparted to the main bow string 78 is undesirable and could have a profound negative affect upon the arrow's accuracy.

To check the alignment of the pulleys 90, 92, a level **80*d* is first placed upon pulley 90. Control screw 47 is then adjusted until pulley 90 is positioned into a substantially true vertical orientation. Thereafter, a level 80*e* is placed against pulley 92 to check its orientation. If pulley 92 is at this point already in a substantially true vertical orientation, the archer is assured that the pulleys are aligned. However, if pulley 92 is significantly offset from a true vertical position, pulleys 90, 92 are seriously misaligned and the bow should be returned to the manufacturer. If, however, pulley 92 is only slightly misaligned from pulley 90, the user may split the difference on the misalignment such that each pulley 90, 92 is equally displaced from a substantially true vertical orientation. This positioning is again accomplished through the use of levels 80*d*, 80*e*. While this will not result in pulleys 90, 92** being more closely aligned with one another, it will facilitate the subsequent operations of precisely positioning the shelf and the sights as discussed below.

Figure 7:
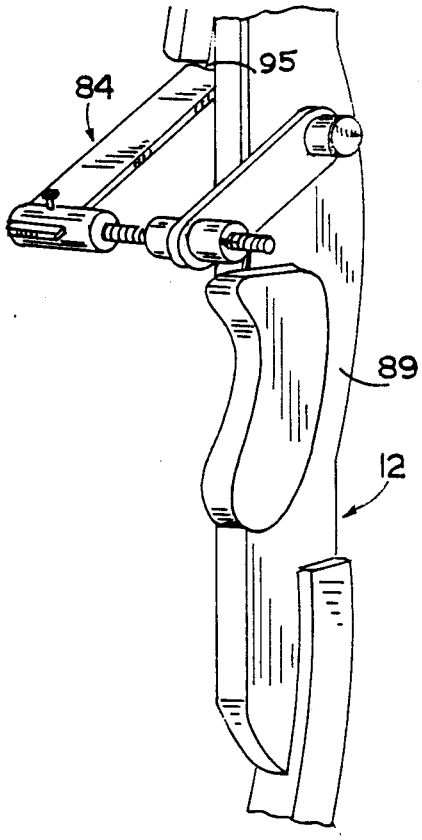
FIG. 7 is a fragmentary perspective view of a bow having an arrow shelf attached thereto.

Hence, assuming that the pulleys 90, 92 are not drastically misaligned, the user, while having the main bow string 78 in a substantially true horizontal orientation, is ready to set the arrow shelf into a precise alignment with bow string 78. This is achieved by attaching a plumb bob 94 to main bow string 78 such that it directly overlies arrow shelf 84 (FIGS. 5 and 7). While many constructions and shapes of arrow shelves exist, they all have in common a specific track location 95 upon which arrow 82 is to traverse. Plumb bob 94 indicates the precise vertical position beneath main bow string 78. With this as a guide, the user then adjusts arrow shelf 84 (FIG. 7) laterally (i.e., inwardly or outwardly from the body 89 of bow 12), until the track portion 95 is directly aligned with the string 94*a* of plumb bob 94.

Alternatively, arrow shelf 84 (FIG. 7) can be precisely aligned with the main bow string 78 with the use of an arrow 82 and level 80 instead of plumb bob 94. In this alternative operation (not shown), an arrow 82 is placed in the bow, after the alignment of the pulleys has been completed, such that it is supported by arrow shelf 84 and engages the main bow string 78 with its notched end. Thereafter, a level is placed on the arrow to facilitate adjustment of the arrow into a substantially vertical orientation. More particularly, arrow 82 is adjusted by laterally moving arrow shelf 84 until the level 80 indicates that the arrow is positioned into a substantially true vertical orientation. Once this vertical orientation has been achieved, the archer is assured that the arrow shelf 84 is aligned with the main bow string 78.

Figure 8:
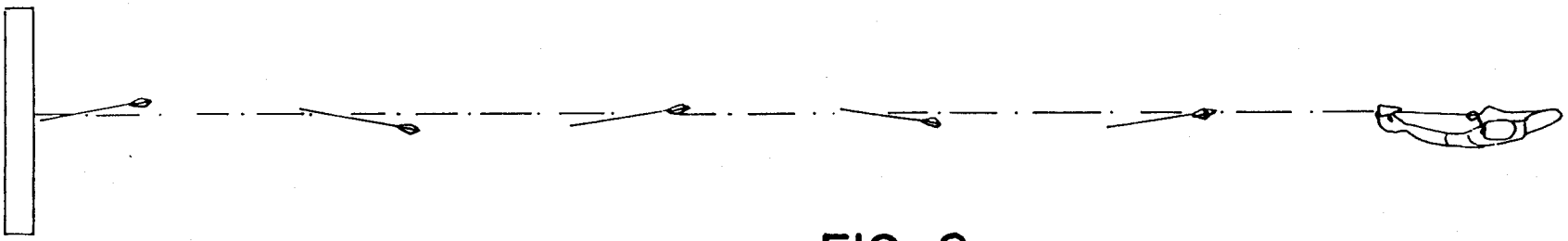
FIG. 8 is an illustration of the shooting problems associated with a misaligned shelf or pulleys.

If the pulleys 90, 92 are misaligned with each other and/or the arrow shelf 84 is not aligned with the main bow string 78, the arrow 82 will be deflected from a true straight flight. As illustrated in FIG. 8, such deflection tends to give the arrow 82 a wobbling flight path in a horizontal plane which invariably negatively affects the accuracy of the shooting.

Additionally, plumb bob 96 can be attached to the bow string 78 at the peep sight 101 so that it hangs downwardly adjacent the sight bar 103 (FIG. 6). As is conventional, sight bar 103 is adjustable laterally (i.e., inwardly and outwardly of body 96). Hence, similar to the adjustment of the arrow shelf 84, sight bar 103 is adjusted until the end thereof is precisely aligned with plumb bob string 96*a*, which in turn places it in alignment with the peep sight 101. With the present invention, therefore, a compound bow can be precisely tested and/or aligned for more accurate shooting.

Additionally, the above described method can, of course, be performed with the use of only one level and plumb bob, rather than a multiple number of each.

The above descriptions are that of preferred embodiments of the invention. Various alterations and changes can be made without departing from the spirit and broader aspects of the invention as set forth in the appended claims, which are to be interpreted in accordance with the principals of patent law, including the doctrine of equivalents.

The embodiments of the invention in which an exclusive property or privilege is claimed are defined as follows:

1. An apparatus for precisely positioning components on archery bows comprising:

a base including a pair of opposed L-shaped braces having elongated parallel spaced apart sidewalls defining a gap therebetween;

an arm pivotally attached to said base and matingly received within said gap, said arm including a pair of oppositely facing side surfaces which contiguously engage said base sidewalls to thereby prevent said arm from moving laterally;

means for pivotally moving said arm; and a mounting bracket rotatably attached to the end of said arm and for rotation about the end of said arm including means for securely attaching an archery bow thereto.

2. The apparatus of claim 1 in which said moving means includes a screw having an abutting end, wherein said screw is threadedly received through said arm and said abutting end abuttingly engages said base, whereby said arm is pivotally moved by rotation of said screw.

3. The apparatus of claim 1 in which said mounting bracket includes a substantially L-shaped structure having a base leg rotatably attached to said arm and a projecting leg for securely attaching an archery bow thereto.

4. An apparatus for precisely positioning components on archery bows comprising:

a base;

an elongated arm pivotally attached to said base for pivotal movement about a first axis;

means for pivotally moving said arm; and a bracket rotatably attached to said arm for movement about a second axis positioned generally orthogonally to said first axis, said bracket further having means for securely attaching an archery bow thereto.

5. The apparatus of claim 4 in which said base includes a pair of opposed spaced apart sidewalls which define a gap therebetween, wherein each sidewall includes a smooth, machined surface, and in which said arm is matingly received within said gap and includes a pair of oppositely facing side surfaces which contiguously engage said machined surfaces on said base sidewalls to thereby prevent said arm from moving laterally.

6. The apparatus of claim 4 in which said moving means includes a screw having an abutting end, wherein said screw is threadedly received through said arm and said abutting end abuttingly engages said base, whereby said arm is pivotally moved by rotation of said screw.

7. The apparatus of claim 4 in which said mounting bracket includes a substantially L-shaped structure having a base leg rotatably attached to said arm and a projecting leg for securely attaching an archery bow thereto.

* * * * *